United States Patent [19]

Vonick

[11] 4,153,860

[45] May 8, 1979

[54] LIGHTING CONTROL APPARATUS

[76] Inventor: Frederick Vonick, 131 Orange Turnpike, Sloatsburg, N.Y. 10974

[21] Appl. No.: 825,236

[22] Filed: Aug. 17, 1977

[51] Int. Cl.[2] ..... H05B 37/02; H01H 47/24

[52] U.S. Cl. ..... 315/155; 250/209; 307/117; 315/159; 361/177

[58] Field of Search ..... 315/155, 159; 361/176, 361/177; 307/117; 362/802; 250/206, 208, 209, 578

[56] References Cited

U.S. PATENT DOCUMENTS

| | | | |
|---|---|---|---|
| 1,767,609 | 6/1930 | Murray | 315/155 X |
| 3,086,146 | 4/1963 | Edler | 361/177 X |
| 3,870,877 | 3/1975 | Tolbird | 250/209 |

*Primary Examiner*—Eugene R. La Roche
*Attorney, Agent, or Firm*—Robert D. Farkas

[57] ABSTRACT

A modular lighting control apparatus utilizes a housing having a plurality of total electric light centers mounted therein, such that the centers may be manually activated by light beams emanating from a hand held flashlight. The housing is provided with a utility outlet receptacle and is operated by a flexible line cord which is energized by a household utility current. Each light sensor controls a character of the outlet voltage available at the output receptacle. One light sensor provides a source of continuous full voltage at the light receptacle. Another light sensor de-energizes the voltage supply to the output receptacle. Still another light sensor causes the voltage, present at the output receptacle, to become intermittent. Yet another light sensor determines the amount of voltage available at the output receptacle. Such housing, utilizes alone or in combination of others, may be installed in conjunction with a Christmas tree lighting apparatus so as to remotely turn on and off lights in various strings about the tree, lights in miniature buildings disposed near the base of the tree and other electrically operated apparatus such as humidifiers or play-back devices of the acoustical variety.

1 Claim, 3 Drawing Figures

LIGHTING CONTROL APPARATUS

BACKGROUND OF THE INVENTION

1. The Field of the Invention

This invention relates to lighting control apparatus, and more particularly to that class which selectively provides continuous interrupted and variable voltages at a receptacle utilized to provide a source of power to lighting or other electrical devices coupled thereinto.

2. Description of the Prior Art

The prior art is replete with photo electric devices which can be utilized to operate electrical appliances when a light beam is projected onto the photo electric device. However, the prior art is continually devoid of a cluster of such photo electric devices each adapted to provide a peculiar control function suitable for such use as in decorative lighting for Christmas trees and related apparatus. The prior art also includes devices which provide energizing power, in a wireless fashion, to Christmas tree lamps which may be remotely located from the Christmas tree. U.S. Pat. No. 2,121,460 issued June 21, 1938 to H. F. Waters and U.S. Pat. No. 2,822,508 issued Feb. 4, 1958 to J. Y. Rabette both teach a source of radio frequency energy adapted to have an antenna closely located in the region of a Christmas tree. The Christmas tree is provided with a source of light emanating from discharge lamps activated totally from the power source in the form of radio waves energizing such lamps. In these applications, the Christmas tree lamp can be remotely controlled by turning on and off the power emanating from the radio frequency generator.

The present invention is markedly different from the aforementioned patents in that the present invention utilizes a conventional wiring scheme from each of the electrical appliances located about the Christmas tree directly wired into a control unit. The control unit may be located in or near the Christmas tree scene and itself is operated remotely by a flashlight hand-held apparatus.

SUMMARY OF THE INVENTION

A primary object of the present invention is to provide an apparatus which can be remotely operated so as to control a plurality of lighting apparatus in a plurality of modes by having a hand-held apparatus of inexpensive design control the control apparatus into each of several of the selective modes.

Another object of the present invention is to provide a photo electric receiver which is independent from and remotely located from light rays emanating from the Christmas tree scene.

Still another object of the present invention is to provide a source of voltage to any one electrical appliance which is continuous interrupted or variable in nature dependent upon which electrical sensor is activated by the hand-held flashlight.

Yet another object of the present invention is to provide an inexpensive apparatus which may be coupled to other similar inexpensive apparatuses so as to allow an individual to build a lighting control module system of any degree of complexity desired.

A still further object of the present invention is to provide an inexpensive and reliable device to accomplish the object of lighting control of low power levels.

Heretofore Christmas tree lighting and control apparatus has consisted of each string of Christmas tree lights being plugged into a convenient outlet either of the "cube-tap" variety or directly into individual convenient outlets. The user was required to insert or remove the plugs leading to each light string individually and to insert flashes thereinbetween so as to construct the type of lighting scene desired. This represented a substantial drawback in the flexibility and convenience of changing the kind of scenes and colors of lights and locations of lights to be illuminated at the will of the user. In order to overcome the convenience portion of the problem the present invention has proved successful in that it enables the user to sit at a substantial distance from the Christmas scene and by operating a hand-held flashlight control each and every lighting function relating thereto as well as controlling other apparatus, such as play-back devices for music or humidifiers or scent generating devices or the like. Thus convenience of operation whilst affording a full range of types of controls including intermittent, continuous, or variable voltage available for each appliance is obtained.

These objects, as well as other objects of the present invention will become more readily apparent after reading the following description of the accompanying drawings.

DESCRIPTION OF THE PREFERRED EMBODIMENT

The structure and method of fabrication of the present invention is applicable to a housing having a number of photo electric units mounted therein, each of the photo electric units are exposed through openings in the housing. The housing is provided with a toggle switch and a line cord which provide operating power for the electronic devices installed within the housing. Additionally, the housing carries a convenient outlet.

Each photo electric unit operates an amplifier. The output of the amplifier is in turn operating a latching circuit which recalls the fact that the photo electric cell has been exposed to a source of light emanating from a hand-held flashlight. The latching circuit in turn operates a variety of devices, amongst which are a series set of contacts installed in series with one or more terminals of the convenient outlet, a flasher type unit, similarly installed in series with one or more terminals of the convenient outlet, a pair of contacts installed in parallel with the contacts of the flasher unit, a dimmer control unit, of conventional design. Thus, the user may be able to energize the convenient outlet in a full on voltage condition, in a full off voltage condition, in a flashing or intermittent voltage condition or at a voltage level at any desired amount as controlled by a series electrical device installed in one or more terminals of the convenient outlet receptacle.

Each housing is similar to other housing which may be stacked in tandem so as to increase the ability of the user to control a plurality of lighting schemes around a Christmas tree, thus permitting a user, over the cost of the years, to adapt his Christmas tree display with a control apparatus whose plurality of outlets can control many functions. Among those functions would be those of lighting up in any continuous or variable voltage or intermittent mode, light strings located on or near the tree or, if desired, a play-back apparatus which would play-back Christmas carols, or if desired, a humidifier which might be utilized to humidify the Christmas tree while simultaneously emitting the scent of pine or other suitable odors. A list of uses is unlimited.

Figure 1:
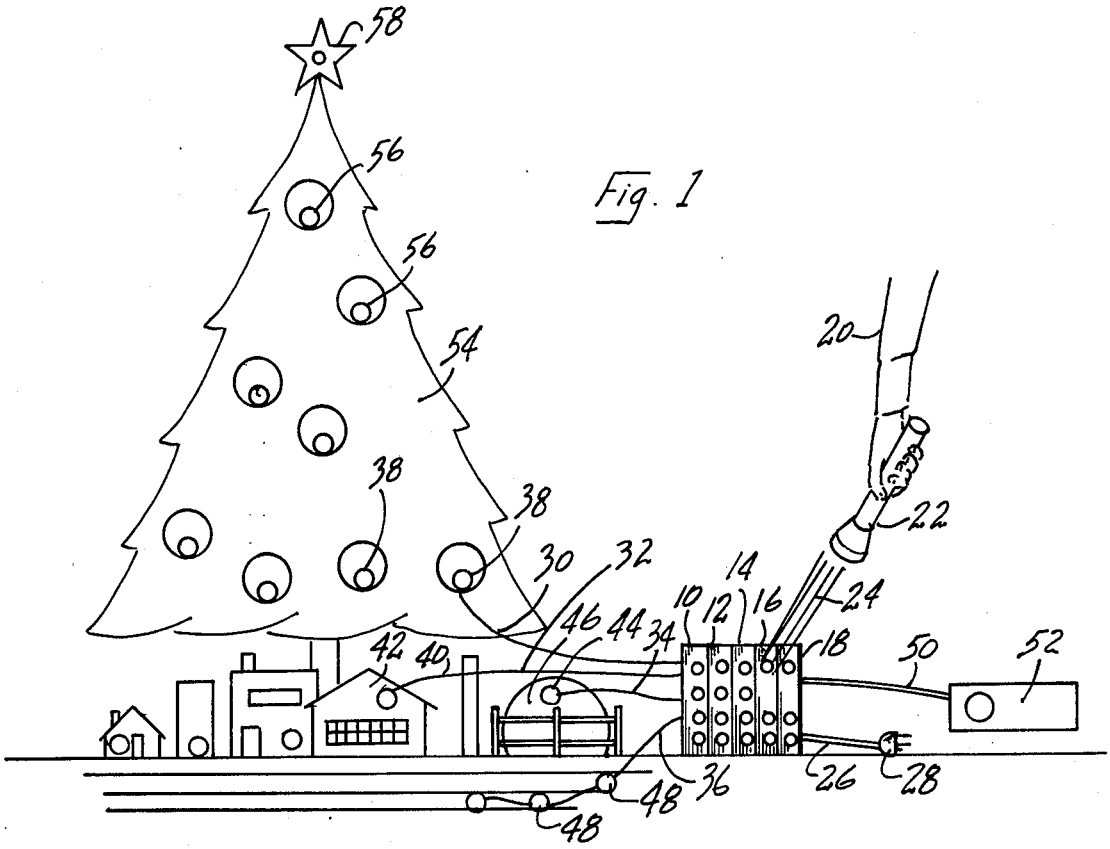
FIG. 1 is a front elevation view of the present invention shown installed in a typical Christmas lighting scheme.

Now referring to the FIGS., and more particularly to the embodiment illustrated in FIG. 1 showing the present invention 10 stacked with a number of similar devices 12, 14, 16, and 18. A user, partially shown by a hand 20, carries a flashlight 22. The flashlight emanates light beams 24 which are directed towards the control modules comprising apparatuses 10, 12, 14, 16 and 18. A line cord 26 is shown provided with a utility plug 28 for insertion into any convenient household utility outlet. Cables 30, 32, 34, and 36 emanate from the control modules and operate lamps 38, lamps 40, not shown, but residing within miniature building 42, lamps 44, shown installed within structure 46 and lamps 48, shown installed on the ground adjacent structure 46, respectively. Cable 50 is connected to a radio or phonograph playback device 52. Device 52 may also include humidifying devices if desired. Christmas tree 54 is shown supporting lamps 56 which may be operated from another control module not shown. Star 58 may similarly be controlled by a control module not shown.

Figure 2:
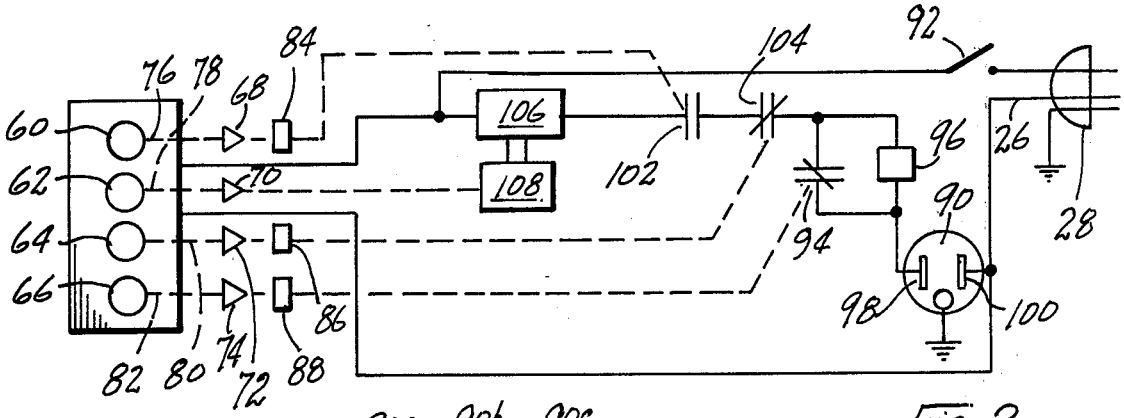
FIG. 2 is a schematic representation of the major element, partially shown in block diagram form of the present invention.

FIG. 2 illustrates housing 10 having openings 60, 62, 64 and 66 therein. Dotted lines 76, 78, 80 and 82 couple photo electric sensitive cell, not shown, behind openings 60, 62, 64 and 66 respectively, to amplifiers 68, 70, 72 and 74 respectively. The amplifiers each provide operating power for the units connected to their respective terminals such that the lights entering the openings 60, 62, 64 and 66, when provided by a flashlight having light rays of sufficient intensity so as to cause the devices connected to the output of the terminal to be energized or operated. Plug 28 is inserted into any convenient household outlet, not shown, so as to provide operating voltage to cable 26. Switch 92 controls the totality of the electronic devices associated with housing 10. It should be understood that all of the apparatus illustrated in FIG. 2 is included within housing 10 with the exception of line cord 26 and plug 28.

Boxes 84, 86 and 88 all depict individual or lock-up circuitry of conventional design well known in the art. For example, they may be relays having contacts of the normal open variety such that when the coils of the relays are energized by the amplifiers connected to the latching circuit, the normally open contact will latch up the relay coil per line providing power to the latching circuit. Alternatively, well known solid state circuitry of the flip-flop variety may be utilized such that a change of state may occur when the output signals from the preceding amplifier reaches a minimum level. In either case the latching circuit will remain in the state of rest and until the light beam is introduced into the photo electric cell preceding the amplifier preceding the latching circuit. Upon the occurrence of the light beam acting on the photo cell the latching circuit will become latched and associated switch contact will be operated. In particular latching circuit 84 operates contacts 102, latching circuit 86 operates contacts 104, and latching circuit 88 operates contacts 94. Contacts 102 are of the normally open variety and contacts 104 and 94 are of the normally closed variety. Contacts 102 and 104 are arranged in a series circuit with dimmer 106 such that terminal 98 is energized upon contacts 102 closing and 104 and 94 remaining closed to the extent that the voltage appears in cable 26, provided dimmer 106 is a short circuit. Thus, amplifier 68 operates contacts 102 acting as an energizing switch for convenient outlet 90, amplifier 72 operates contacts 104 acting as a shut-off circuit for convenient outlet or receptacle 90 and amplifier 74 operates normally closed contacts 94, which when opened permits flasher 96 to control and interrupt periodically a voltage available at terminals 98 and 100. Amplifier 70 is directly connected to motor 108 which operates dimmer 106. Dimmer 106 may be provided with a potentiometer whose shaft is coupled to motor 108. Thus, as long as a light beam enters opening 62, amplifier 70 drives motor 108 causing the resistance or impedence of dimmer 106 to decrease until the impedence level is minimized at which point the impedence level is greatly increased starting the cycle of decreasing thereforth. This scheme may be supplanted by a solid state beam, well known in the art such as a memory circuit which is responsive to the presence of light in opening 62 such that the memory circuit controls the gates of S.C.R.'s disposed in dimmer box 102.

Thus the apparatus shown in FIG. 2 is capable of permitting the voltage available at terminals 98 and 100 to be on and off at will, when on to be intermittent in function, and when on to be of whatever desired magnitude up to a maximum level of that available at plug 28.

Figure 3:
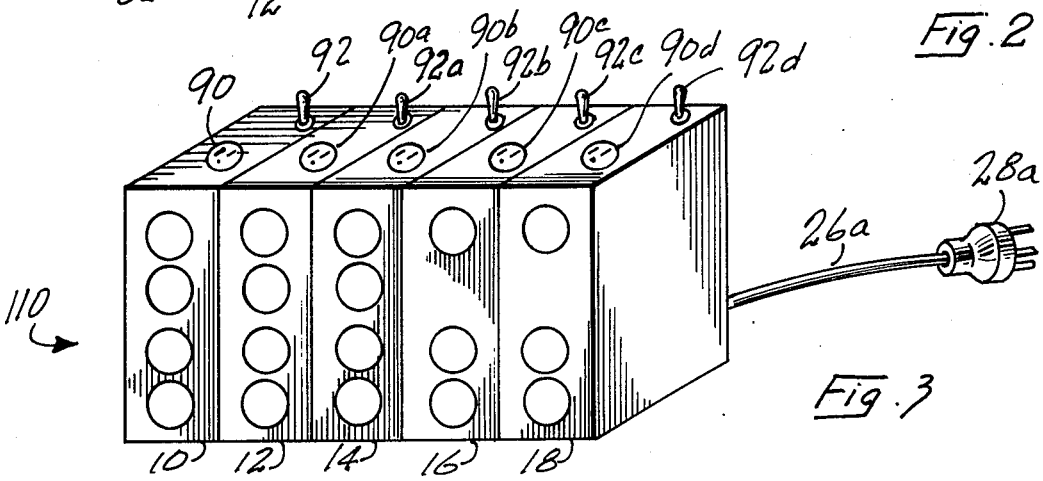
FIG. 3 is a perspective view of a plurality of modular units made up by the electrical apparatus depicted in FIG. 2.

FIG. 3 illustrates housing 10, 12, 14, 16, 18 all stacked together so as to make up assembly 110. Line cord **26*a* and associated plug 28*a* are shown illustrated feeding housing 18. Housing 10, 12, 14, and 16 may be provided with individual line cords and plugs. Receptacle 90, 90*a*, 90*b*, 90*c* and 90*d* each may be utilized to provide operating power to various electrical devices, such as the varieties indicated in FIG. 1**.

One of the advantages of the present invention is an apparatus which can be remotely operated so as to control a plurality of lighting apparatus in a plurality of modes by having a hand-held apparatus of inexpensive design control the control apparatus into each or several of the selective modes.

Another advantage of the present invention is a photo electric receiver which is independent from and remotely located from light rays emenating from the Christmas tree scene.

Still another advantage of the present invention is a source of voltage to any one electrical appliance which is continuous interrupted or variable in nature dependent upon which electrical sensor is activated by the hand-held flashlight.

Yet another advantage of the present invention is an inexpensive apparatus which may be coupled to other similar inexpensive apparatuses so as to allow an individual to build a lighting control module system of any degree of complexity desired.

A still further advantage of the present invention is an inexpensive and reliable device to accomplish the object of lighting control of low power levels.

Thus there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. A lighting control apparatus comprising a housing, a plurality of openings in said housing, a plurality of photo electric cells disposed in said housing located behind said plurality of openings, a first amplifier coupled to a first latching circuit, a first one of said plurality of photo electric cells coupled to said amplifier, a second amplifier coupled to a second latching circuit, a second one of said plurality of photo electric cells coupled to said second amplifier, a third amplifier coupled to a third latching circuit, a third one of said plurality of photo electric cells coupled to said third amplifier, a fourth amplifier coupled to a control apparatus, a fourth one of said plurality of said photo electric cells coupled to said fourth amplifier, a variable impedence element, said control apparatus coupled to said impedence element, for controlling said impedence element, said first latching circuit coupled to a pair of normally open contacts, said second latching circuit coupled to a first pair normally closed contacts, said third latching circuit coupled to a second pair of normally closed contacts, a flasher, a receptacle, said receptacle having a pair of terminals, a switch, said switch having a first and a second pole, a plug, said plug having a pair of terminals, a line cord, said cord having a first and a second electrical conductor, said pair of terminals of said plug individually coupled to said first and said second conductor of said line cord at one end of said line cord, said first conductor coupled to said first pole of said switch at the other end of said line cord, the end of said second conductor located at said other end of said line cord coupled to one of said terminals of said receptacle, said second pole of said switch coupled to one terminal of said impedence, the other terminal of said impedence coupled to one contact of said normally open contacts, the other contact of said normally open contacts coupled to one terminal of said first normally closed contacts, the other terminal of said first normally closed contacts coupled to a junction of the first terminal of said second normally closed contacts and one terminal of said flasher, the other terminal of said second normally closed contacts and the other terminal of said flasher coupled to the other terminal of said receptacle, means for said fourth amplifier driving said control apparatus, means for said control apparatus varying the impedence of said variable impedence element said first and said second and said third latching means for latchingly operating said normally open contacts and said first and said second normally closed contacts into an opposite state upon the appearance of light in selected said openings of said housing.

* * * * *